US008262261B2

(12) United States Patent
Rossi

(10) Patent No.: US 8,262,261 B2
(45) Date of Patent: Sep. 11, 2012

(54) HIGH POWER LED LAMP FOR TRAFFIC LIGHT

(75) Inventor: Paolo Rossi, Naples (IT)

(73) Assignee: Self Sime Italia Ricera & Sviluppo S.r.l., Naples (IT)

( * ) Notice: Subject to any disclaimer, the term of this patent is extended or adjusted under 35 U.S.C. 154(b) by 195 days.

(21) Appl. No.: 12/864,972

(22) PCT Filed: Feb. 6, 2009

(86) PCT No.: PCT/IT2009/000040

§ 371 (c)(1),
(2), (4) Date: Jul. 28, 2010

(87) PCT Pub. No.: WO2009/101646

PCT Pub. Date: Aug. 20, 2009

(65) Prior Publication Data

US 2011/0018437 A1 Jan. 27, 2011

(30) Foreign Application Priority Data

Feb. 15, 2008 (IT) ..... NA2008A0011

(51) Int. Cl.
*F21V 29/00* (2006.01)

(52) U.S. Cl. ..... 362/294; 362/373

(58) Field of Classification Search ..... 362/294, 362/373

See application file for complete search history.

(56) References Cited

U.S. PATENT DOCUMENTS

| | | | | |
|---|---|---|---|---|
| 2003/0040200 | A1 | 2/2003 | Cao | |
| 2005/0254264 | A1 | 11/2005 | Sidwell et al. | |
| 2006/0007690 | A1 | 1/2006 | Cheng | |
| 2006/0193130 | A1 | 8/2006 | Ishibashi | |
| 2008/0094249 | A1 * | 4/2008 | Pappas et al. | 340/906 |
| 2009/0080205 | A1 * | 3/2009 | Chang et al. | 362/373 |

FOREIGN PATENT DOCUMENTS

WO 2004/053385 A2 6/2004

OTHER PUBLICATIONS

International Search Report, dated May 8, 2009, from corresponding PCT application.

* cited by examiner

*Primary Examiner* — Evan Dzierzynski
(74) *Attorney, Agent, or Firm* — Young & Thompson

(57) ABSTRACT

A vehicular traffic light lamp includes a higher part defining final optic capacities of the lamp and composed by a truncated pyramid aluminum heat sink with plural sides, a higher area, and a lower plate; a high power led situated on each side of the higher part; a lower part comprised of an electronic component and a lampbase; and a transparent plastic cover.

6 Claims, 3 Drawing Sheets

HIGH POWER LED LAMP FOR TRAFFIC LIGHT

BACKGROUND OF THE INVENTION

This invention regards a high power led lamp for traffic lights. The precise disposition of the led permits a total exploitation of the parabola, present in all traffic light models, comporting consequently a homogeneity of the beam that entirely fills the coloured lens situated in front of the lamp.

DESCRIPTION OF THE RELATED ART

At the present time led lamps on market are realized with a conspicuous number of leds (low power), situated on a disc which owing to the proper dimensions, covers and consequently does not use the reflecting parabola of the traffic light. With the current led lamps (low power) the removal of the parabola is necessary. In this way the structure is changed and consequently also the homologation of the traffic light. Likewise it is evident that the utilization of a greater number of leds permits an increase of a probable break down of the single element and therefore, to the same extent, increases the decline of the general light performance of the lamp. A further point against the lamps currently present on the market is the incapacity to monitor its correct and complete function with a current control, the obvious consequence is the probability of having not entirely functioning light sources in the streets, without the possibility for the service man to realize it.

SUMMARY OF THE INVENTION

Regarding the high power led lamp, an electronic system is provided for permitting to allow the total switching off the lamp, even in case of a single led being out of function: then this characteristic allows us to monitor the device at distance, to identify the damage and to intervene immediately.

DESCRIPTION OF THE PREFERRED EMBODIMENTS

The high power led lamp, conceived to function with tension equal to or lower than 220 VAC, turns out to be consistent with any sort of traffic light regulator, and it interfaces towards this in such a way to be lighted up (at the traffic light regulator) in case of precise and complete function, whereas it results switched off (at the traffic light regulator) in case of any damage, as happens using the common incandescent light bulbs.

Power leds are projected to be light sources and in this way they differ from other LEDs used for signalling in dashboards and display; they send sufficient light for many applications of general and special illuminations and are already widely installed in the spotlights of the theatrical scenographies, in into the high power flash lamps and even in the headlights for cars.

High power leds offer high light efficiency and are in rapid evolution, power supply at very low tension, extreme versatility in the design, absence of UV and infrared emission (leds don't fade or heat the illuminated objects), instant lighting, also at very low temperatures, high mechanical resistance and even resistance towards vibrations.

Figure 1:
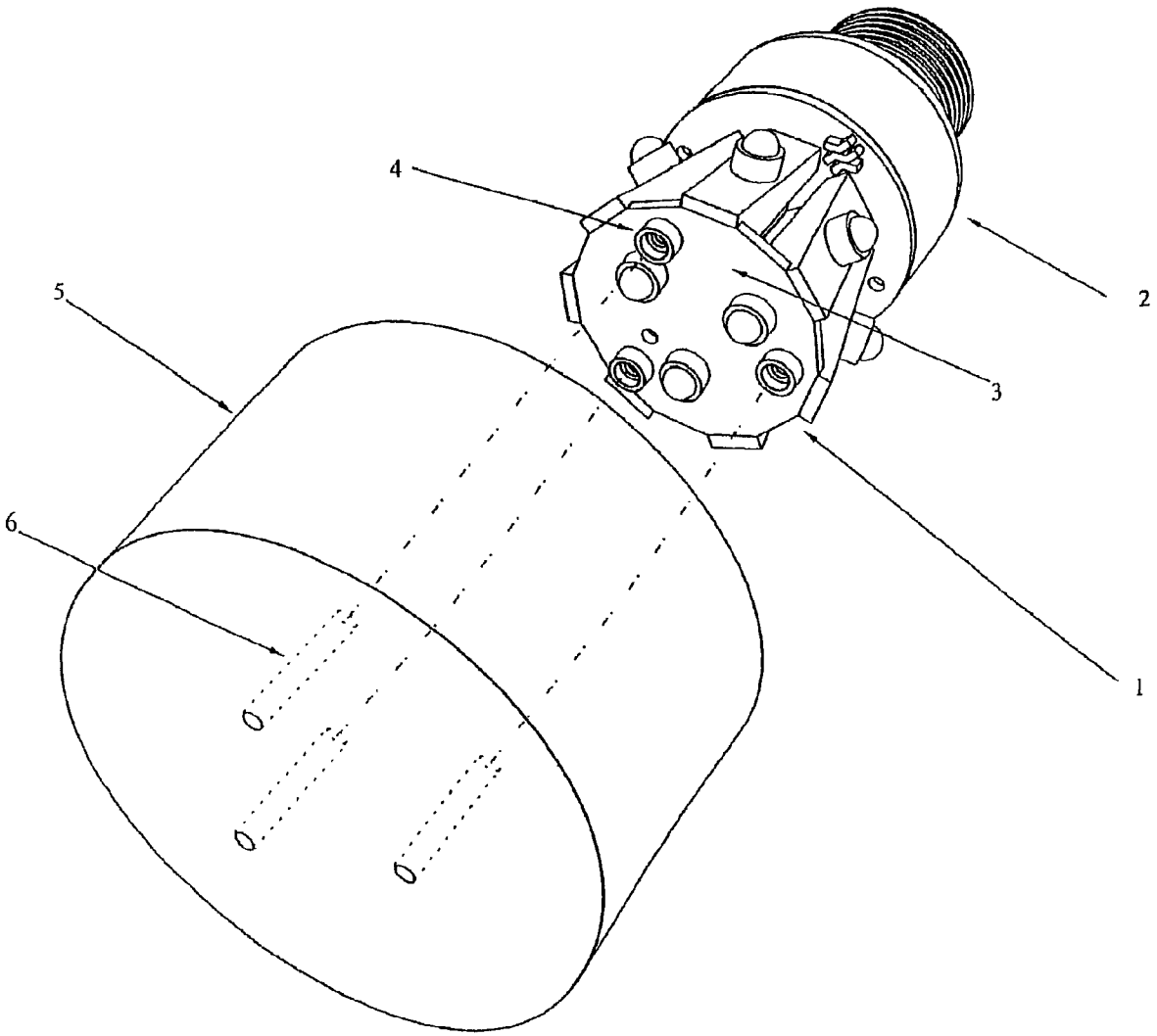
FIG. 1 shows the higher part and cover of the inventive high power led lamp.

The high power led lamp (FIG. 1) is constituted by a higher part 1 of FIG. 1 on which the leds are situated and of a lower part, in which the electronic component and the E27 lampbase are located. The higher part 1 defines the final optic capacities of the lamp and is composed by a truncated pyramid aluminium heat sink with seven sides 1 of FIG. 2 on each of which is situated a led.

Aluminium heat sink is scheduled to avoid the determination of extreme heating around the leds; an overheating might soon determine a reduction of the light power of the lamp. In this case owing to the obvious property of the thermal conductivity of the aluminium, the heat generated by the leds is transferred by conduction towards areas characterized by a lower temperature, and by convection towards the outside environment.

Figure 2:
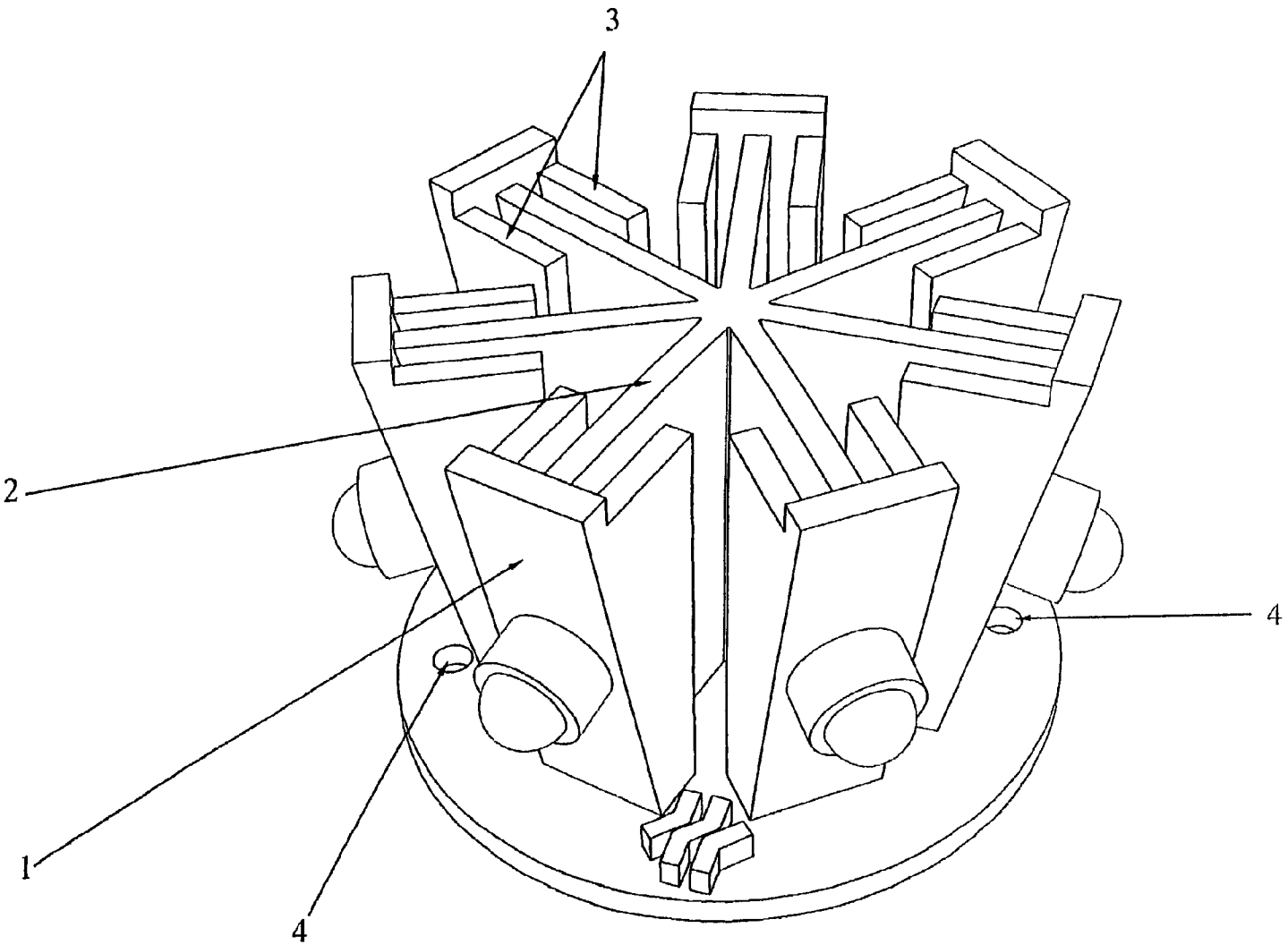
FIG. 2 shows the heat sink of the inventive high power led lamp.

In order to obtain this result all the sides of heat sink are connected to a principal trapezoidal contour finning 2 of FIG. 2 that links it to a central cylinder. In this manner the double effect of thermal transfer and of structural connection is obtained. In order to increase the dissipated surface and consequently the light efficiency of the lamp two trapezoidal contour wings 3 of FIG. 2 have been inserted at the edges of each side of the heat sink.

On the higher area of the heat sink 3 of FIG. 1, three high power leds are disposed, situated with an angulation of 120° one from each other. On this level, furthermore, three cylindric tubular plugs 4 of FIG. 1 are present. The tubular plugs are serving as a connection for the cover in transparent plastic 5 of FIG. 1 which whose function is to protect all the lamp leds and to facilitate the insertion and the extraction.

This plastic cover has the form of a glass inside which are placed three concave pins which have to be inserted in the plugs 6 of FIG. 1 present on the higher area of the heat sink.

At the bottom the heat sink presents a little cylindric plate characterized by two through and reverse threaded holes 4 of FIG. 2 necessary for the connection to the electronic component of the lamp by means of two metric screws.

Both on the higher area and on the lower plate of the heat sink, two holes have been performed for the passage of the wires which have to reach the electronic component. The form of the described heat sink, therefore, permits the above-situated leds to address their light source towards the aluminium parabola which will be able to reflect the light towards the coloured lens, thus obtaining an effect of bright uniformity. Furthermore this reflection does not implicate loss of intensity, resulting widely beyond the lowest requisites requested by the standards of the road. In this connection, some laboratory experiments have been carried out by the Faculty of Engineering at the University of Genoa, based on the specifications defined by the UNI EN 12368 standard; these tests prove that the opening of the light source of the single leds, in combination with their optimum disposition, permits to reach values of bright intensity, conspicuous too as to horizontal and vertical angulations of +30°.

Figure 3:
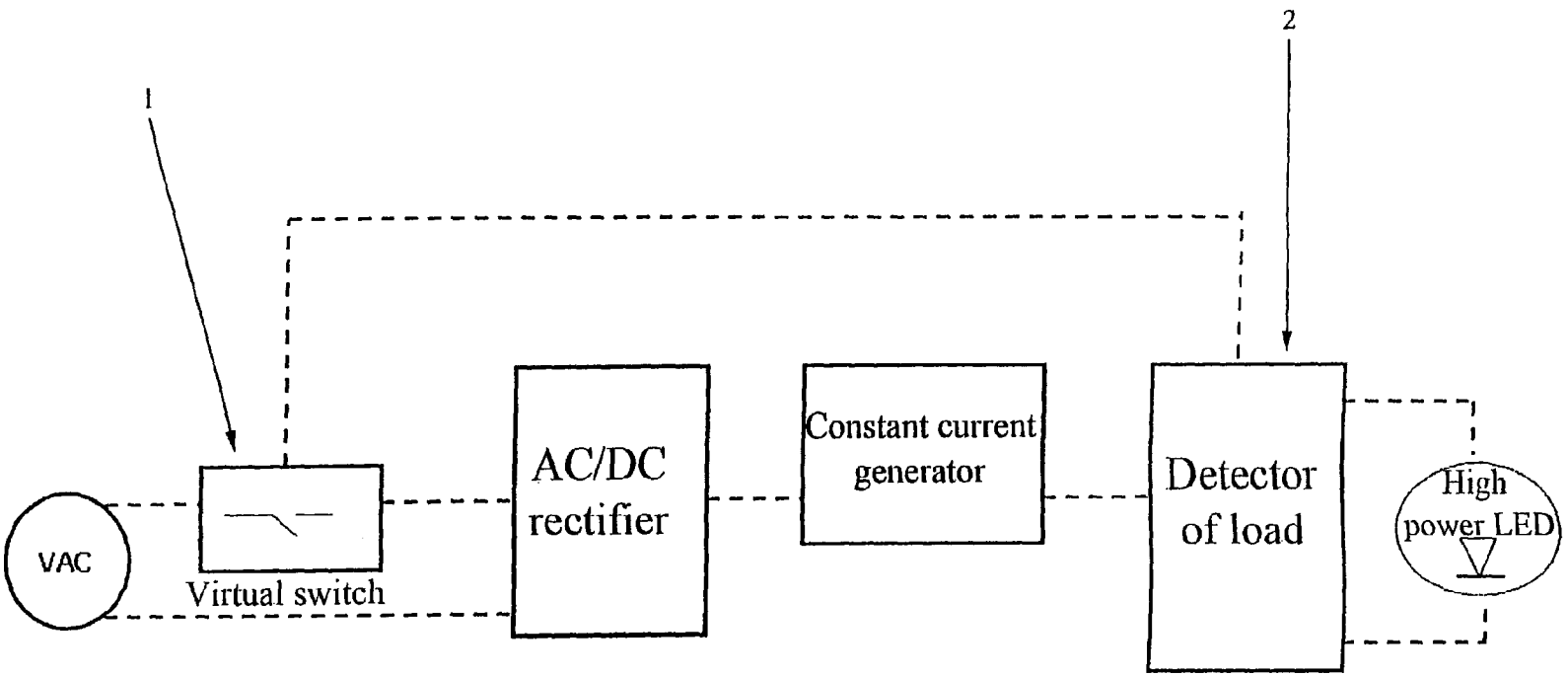
FIG. 3 shows an electric circuit of the inventive high power led lamp.

In order to connect among each other the leds, situated on the higher and lateral surface of the heat sink, is used a flexible printed circuit board, sticked on the heat sink. Printed circuit board is the component necessary to create an electric link between the 10 leds in order to establish a correct and suitable electric circuit; furthermore the mechanical workability of the stand enables the shaping of the edges (by means of milling or shearing) in order to enable the mechanical housing slot on geometries of even complex forms. In this case the outline of the printed circuit board follows the contour defined by the lateral and by the higher sides of the heat sink. On choosing the printed circuit board, particular attention has been paid to the values of thermal stability; extreme size change might actually cause a dysfunction of the entire electronic circuit. The electronic component of the lamp can be schematized as in FIG. 3.

The outstanding characteristic of the electronic component is to make the lamp act, reproducing exactly the same functions as the filament of an incandescent lamp. By means of a loaded signal tracer 2 of FIG. 3, the absorption of current of the leds of high luminous intensity is monitored; subsequently the feedback of this monitoring is sent to a virtual isolator 1 of FIG. 3, which is able to open and to close the circuit in case of complete, but also partial dysfunction of the leds, hence provoking an interruption of the circuit, just as happens in case of a burnt filament in an incandescent lamp.

The invention claimed is:

1. A vehicular traffic light lamp, comprising:

a higher part defining final optic capacities of the lamp and comprised by a truncated pyramid heat sink with plural sides, a higher area covering the plural sides, and a lower plate;

a high power led situated on each side of the heat sink;

a lower part comprised of an electronic control component and a lampbase, the electronic control component connected to the lower part via the lower plate;

a trapezoidal contour finning connected to each of the plural sides of the heat sink;

two trapezoidal contour wings attached to each of the sides of the heat sink;

high power leds disposed on the higher area of the heat sink;

cylindric tubular plugs present on the higher area of the heat sink; and a transparent plastic cover connected to the plugs.

2. The lamp of claim 1, wherein, the the heat sink is aluminum and comprises seven sides, three (3) high power leds are disposed on the higher area of the heat sink and situated with an angulation of 120° one from each other, the electronic control component is compatible with traffic lights regulators, the electronic control component comprises electronics that interface with the traffic light regulators in order to be switched for regular function and to be switched off in case of malfunction, the electronic control component is fed at a voltage of 220 VAC or lower, and further comprising a flexible printed circuit on the heat sink providing an electric link between the leds and electronic control component.

3. The lamp of claim 1, wherein the cover is comprised of a inside glass and pins placed in the glass and inserted in the plugs.

4. The lamp of claim 3, wherein, the lower plate has threaded holes providing a connection, via screws, to the electronic component, and the lampbase is a E27 lampbase.

5. A vehicular traffic light lamp, comprising:

a higher part comprised of a truncated pyramid heat sink with plural sides, a top area extending across the plural sides, and a lower area;

a high power led situated on each side of the heat sink and on the top area of the heat sink;

a lower part comprised of an electronic control component and a lampbase, the electronic control component connected to the lower part via the lower area;

a trapezoidal contour finning connected to each of the plural sides of the heat sink;

wings attached to each of the sides of the heat sink; and a transparent cover connected to the top area of the heat sink.

6. The lamp of claim 5, wherein, the the heat sink is aluminum and comprises seven sides, and three (3) high power leds are disposed on the higher area of the heat sink and situated with an angulation of 120° one from each other.

* * * * *